United States Patent [19]

Frantzreb, Sr.

[11] 4,355,680

[45] Oct. 26, 1982

[54] METHOD AND APPARATUS FOR CONTINUOUS CASTING OF HOLLOW ARTICLES

[75] Inventor: John G. Frantzreb, Sr., Peoria, Ill.

[73] Assignee: Caterpillar Tractor Co., Peoria, Ill.

[21] Appl. No.: 203,008

[22] Filed: Nov. 3, 1980

[51] Int. Cl.[3] ..... B22D 11/10; B22D 11/00

[52] U.S. Cl. ..... 164/484; 164/488; 164/421; 164/439

[58] Field of Search ..... 164/488–490, 164/484, 459, 133–135, 421, 437, 439, 440

[56] References Cited

U.S. PATENT DOCUMENTS

| | | | |
|---|---|---|---|
| 3,863,706 | 2/1975 | Chandley et al. | 164/255 |
| 3,872,913 | 3/1975 | Lohikoski | 164/64 |
| 4,146,079 | 3/1979 | Anisovich et al. | 164/85 |
| 4,185,684 | 1/1980 | Zabara et al. | 164/263 |

FOREIGN PATENT DOCUMENTS

| | | | |
|---|---|---|---|
| 770650 | 10/1980 | U.S.S.R. | 164/490 |

OTHER PUBLICATIONS

Hale H. Hursen, "Pressure Casting of Steel", *Metal Progress*, Apr. 1963, pp. 67–71.

*Primary Examiner*—Gus T. Hampilos
*Assistant Examiner*—K. Y. Lin
*Attorney, Agent, or Firm*—Robert A. McFall

[57] ABSTRACT

A method and apparatus (10) for the continuous casting of hollow articles (12) provides for the removal of liquid metal (49) from a mold (20) concurrently with the withdrawal of the solidified article (12). Undesirable reaction products, such as oxides, sulfides, and ceramic compositions, are commonly included in cast articles, reducing the mechanical and physical properties of the article and producing a product of inferior quality. The problem is solved by continuously casting molten metal (16) in a vertically oriented mold (20) and draining the contaminate enriched liquid (49) from an upper end (24) of the mold (20), thereby washing undesirable impurities from the freezing zone resulting in a clean, dense hollow article (12) having superior properties. Seamless mechanical tubing suitable for oil field and hydraulic cylinder applications can be produced by this process.

10 Claims, 1 Drawing Figure

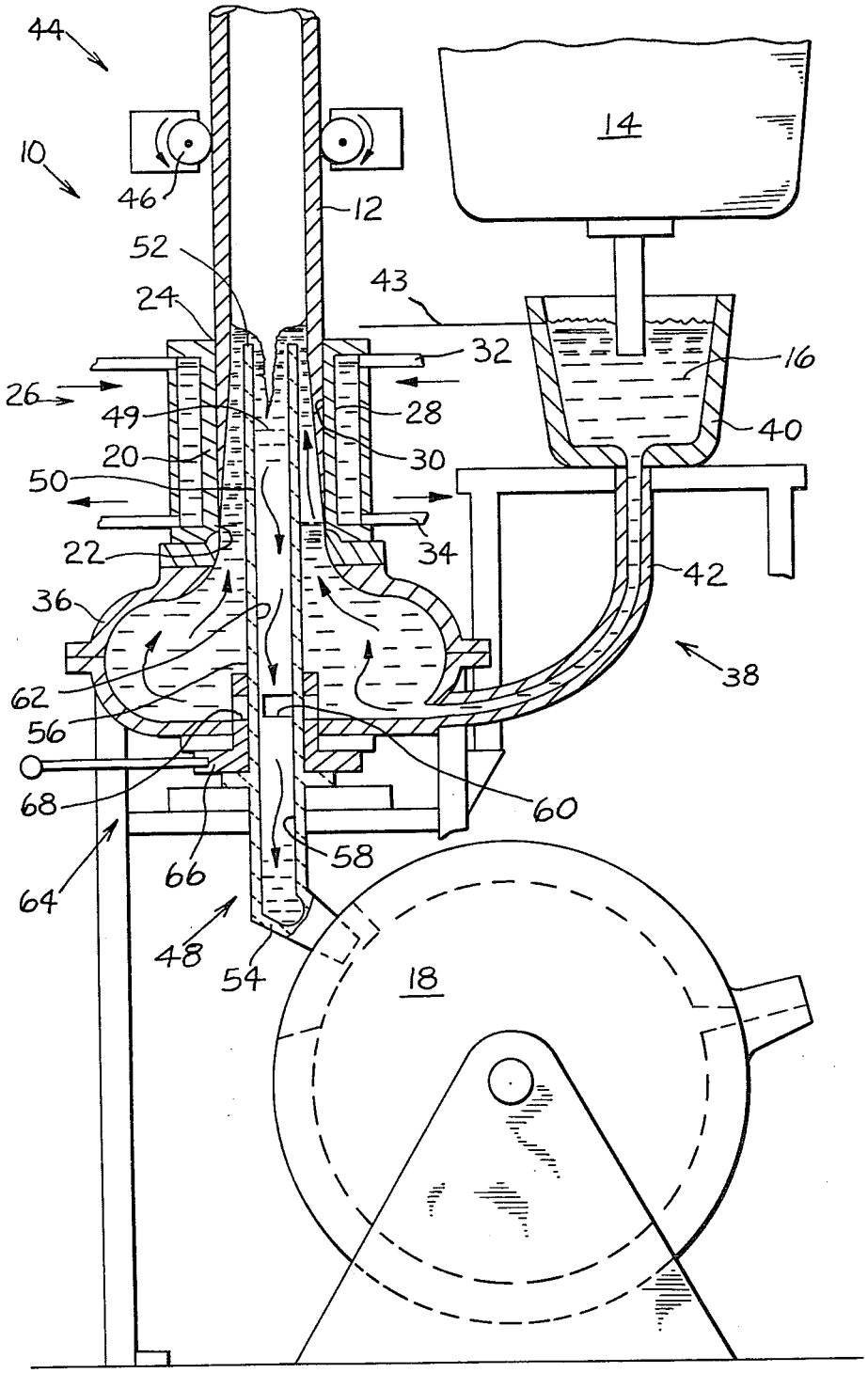
44
10
46
12
14
52
24
43
32
16
26
49
28
40
20
30
50
34
22
42
36
38
62
56
68
60
66
58
64
48
54
18

METHOD AND APPARATUS FOR CONTINUOUS CASTING OF HOLLOW ARTICLES

DESCRIPTION

Technical Field

This invention relates generally to a method and apparatus for the shaping of fluid metallic material and more particularly to a method and apparatus for the continuous casting of hollow articles.

Background Art

Hollow cast articles, such as seamless steel tubing, are generally manufactured by one of three processes. In the first process, molten steel is cast into large ingot molds and allowed to solidify. The ingots are subsequently reheated and rolled to form a billet of the size required for the desired end product. The rolled billets are again reheated, pierced on a center mandrel, and then rolled or drawn over the mandrel to form the seamless tubing. In the second process, molten steel is cast into individual permanent graphite molds, then subsequently hot pierced and drawn over mandrels.

In each of the processes outlined above, the physical and mechanical properties of the finished hollow article are determined by the solidification characteristics of relatively large masses of molten metal. For example, in ingot molds, solidification starts with a thin shell formed against the mold face followed by progressively slower cooling of the remaining liquid core. Typically, in steel castings, three distinct metallurgical zones are formed, varying in thickness according to the cooling rate of each zone. The first, or chill, zone has a dendritic structure in which the crystals are formed normal to the mold face with little or no branching. The second, or intermediate, zone cools at a slower rate, thereby providing a greater number of nucleation sites having stubby or imperfectly branched arms. The center, or core, zone contains randomly oriented, well formed equiaxed dendrites. Hot working of the steel ingot is required to break up and distribute these coarsely segregated areas to produce acceptable mechanical properties. However, even with hot working, the central core area is frequently found to be contaminated with nonmetallic inclusions, alloy segregation and microporosity.

The third process attempts to overcome the above problem by continuously casting molten steel into a water-cooled copper mold, forming a product to near net size, and subsequently drawing the cast article over a mandrel. More recently, a process has been developed for the continuous casting of hollow articles by "drawing-up" or casting in a "vertical up" mode. A machine for continuous casting by drawing-up is described in U.S. Pat. No. 4,185,684 which was issued to Jury G. Zabava, et al on Jan. 29, 1980. A method and apparatus for continuous upwards casting of hollow articles are also disclosed in U.S. Pat. No. 3,872,913 which was issued to Timo Jorma Juhani Lohikoski on Mar. 25, 1975 and U.S. Pat. No. 4,146,079 which was issued to Gennady A. Anisovich, et al on Mar. 27, 1979. More particularly, Lohikoski discloses a water-cooled graphite mold through which molten metal is drawn upwardly by suction and cooled within the mold. Anisovich discloses a specific design for a water-cooled mold and a process for controlling the rate of heat removal from the surface of the cast article as it is withdrawn upwardly from the mold.

I have found that when molten metal is cast into a water-cooled or graphite chill mold, the chill zone forms by crowding undesirable material ahead of the freezing front, thereby producing a relatively clean shell and enriching the remaining liquid with oxygen, sulphur, phosphorous and solid ceramic reaction products. An article containing these undesirable products will have lowered fatigue characteristics and inferior physical properties.

In the prior art devices described above, no provision is made for the removal of these undesirable products and therefore the products are entrapped in the article as it solidifies.

The present invention is directed to overcoming one or more of the problems as set forth above.

DISCLOSURE OF THE INVENTION

In accordance with one aspect of the present invention, a method for continuous casting provides for the removal of liquid metal concurrently with the withdrawal of a solidified hollow article from the mold.

In another aspect of the present invention, an apparatus for the continuous casting of hollow articles includes a means for removing liquid metal from an upper discharge end of a mold.

Present processes for the manufacture of elongated hollow articles, such as seamless steel tubing, form such articles by solidifying all of the molten metal delivered to a mold device. Often, the molten metal contains undesirable products which are present upon delivery to the mold device or are reaction products formed during pouring or solidification of the molten metal. Consequently, these undesirable products become incorporated into the cast article, thereby producing a product of inferior quality.

The above problem is solved by continuously casting molten metal in a cooled mold in the vertical-up mode and draining the contaminate enriched liquid away from the mold. This removes or washes undesirable impurities from the freezing zone resulting in a clean, dense hollow article having superior mechanical and physical properties. Seamless mechanical steel tubing produced by this process is especially desirable for use in applications requiring a long fatigue life such as oil well tubing and hydraulic cylinder barrel stock.

BRIEF DESCRIPTION OF THE DRAWING

The single FIGURE of the accompanying drawing is a general side view of an apparatus for the continuous casting of hollow articles according to the present invention, with portions of the apparatus shown in section.

BEST MODE FOR CARRYING OUT THE INVENTION

In the preferred embodiment of the present invention shown in the drawing, an apparatus 10 for the continuous casting of a hollow article 12 is shown in conjunction with a ladle 14 containing a supply of molten metal 16 and a holding furnace 18.

The apparatus 10 includes a vertically-oriented mold 20 having a lower inlet end 22 and an upper discharge end 24. Preferably, the mold is a rotating copper mold of the type generally known in the art and includes a means 26 for cooling the mold. The means 26 for cooling typically includes an internal cavity 28 adjacent an article-shaping surface 30, an inlet conduit 32 and an outlet conduit 34 for circulating a fluid such as water through the cavity 28.

A casting breech 36 is attached to the mold 20 and is in communication with the lower inlet end 22 of the mold. A means 38 for providing the supply of molten metal to the casting breech includes a tundish 40 connected to the breech by a supply tube 42. In normal operation, molten metal in the tundish 40 is maintained at a predsetermined level 43, only slightly elevationally above the discharge end 24 of the mold 20.

A means 44 for continuously withdrawing the solidified hollow article 12 from the upper end 24 of the mold 20 includes a pair of conventionally powered rollers 46. As is well known in the art, such rollers 46 re commonly mounted for synchronous rotation with the mold 20.

The apparatus 10 also includes a means 48 for removing liquid metal 49 from the upper end 24 of the mold 20 concurrently with the withdrawal of the solidified hollow article 12. The means 48 for removing liquid metal includes a drain tube 50 having an inlet end 52 and a discharge end 54. The tube 50 is centrally disposed within the mold 20 and the casting breech 36 with the inlet end 52 positioned elevationally adjacent the upper end 24 of the mold 20 and the discharge end 54 spaced elevationally below the casting breech. The drain tube 50 includes an external wall 56, an internal wall 58, and at least one transverse port 60. The internal wall defines a longitudinal passage 62 between the inlet and discharge ends 52,54 of the tube and the transverse port 60 communicates the external wall 56 with the longitudinal passage 62.

A means 64 for draining the mold 20 and the casting breech 36 includes a rotary gate valve 66 partially disposed within the casting breech 36 and circumscribing a portion of the external wall 56 of the drain tube 50. The valve includes at least one port 68 that is positionable between a first position shown in the drawing, at which the port 68 is non-aligned with respect to the transverse port 60 in the drain tube, and a second position at which the port 68 is in alignment with the transverse port 60.

Industrial Applicability

The apparatus 10 for the continuous casting of hollow articles 12 is placed in operation by moving the rotary gate valve 66 to the first position, as shown in the drawings, thereby covering the transverse port 60 in the drain tube 50 and preventing the flow of molten metal 16 directly from the breech 36 to the drain tube. The holding furnace 18 is brought up to the desired temperature and positioned so that the discharge end 54 of the drain tube 50 extends into an opening of the furnace.

A water flow for cooling the mold 20 is established by opening the appropriate valves, not shown. A starter bar having dimensions substantially equal to the desired article 12 is placed at the upper end 24 of the mold 20. Molten metal 16 is delivered from a melt shop by the ladle 14, to the tundish 40, and then through the supply tube 42 to the casting breech 36. The liquid metal level in the tundish 40 is maintained at a predetermined level 43 by regulating the flow of metal from the ladle 14 to the tundish. Additionally, good casting practice calls for the maintenance of a protective slag cover over the molten metal in the tundish 40.

Since the rotary gate valve 66 is closed, molten metal 16 fills the casting breech 36 and rises in the mold 20 until it reaches a level substantially equal to the predetermined level 43 of the molten metal in the tundish 40. As the liquid metal comes into contact with the cooled shaping surface 30 of the mold 20, the metal begins to solidify and forms a solidified first portion or article 12. As the metal continues to solidify and thereby increase in wall thickness, undesirable material such as oxides, sulfide compositions and other reaction products form ahead of the freeze zone and are washed upwards and away from the solidified first portion or hollow article 12 by the remaining liquid second portion 49. The solidified first portion 12 is withdrawn from the upper end 24 of the mold 20 by actuating the powered rollers 46.

After rising upwardly to the predetermined level 43, the contamination enriched liquid second portion 49 is drained away by flowing into the inlet end 52 of the drain tube 50, through the longitudinal passage 62 and out of the discharge end 54 into the holding furnace 18 for subsequent additional refining. Thus, the liquid second portion 49 is removed from the upper end 24 of the mold 20 concurrently with withdrawal of the solidified first portion or article 12 from the same upper end 24 of the mold.

The relative rates of solidification and liquid flow into the drain tube 50 will depend on variables which are well known and recognized in the art. For example, a formula is well known for determining the withdrawal rate of the solidified article when all of the molten metal is formed into a solid article.

In the present invention, it is desirable to maintain a liquid linear flow rate greater than the linear extraction rate of the solid article 12 to assure adequate washing action along the freezing front of the solid article adjacent the liquid metal 49. For example, it is calculated that, for forming a tubular article having a 0.152 m (6 inch) outside diameter and a 0.102 m (4 inch) inside diameter, and withdrawing the finished article at a linear rate of 0.034 m/s (1.33 in/sec), the drain tube provided should have an outside diameter of approximately 0.081 m (3.2 inches); to provide a linear flow rate for the second liquid portion at the upper end 24 of the mold 20 of approximately 0.068 m/s (2.67 inches/second).

Upon completion of the continuous casting operation, the rotary gate valve 66 is moved to the second position wherein the port 68 in the valve is in alignment with the transverse port 60 in the drain tube 50. In this position, the ports cooperate to drain the mold 20, the tundish 40, the supply tube 42, and the casting breech 36 of molten metal by directing the metal through the longitudinal passage 62 to the holding furnace 18.

Alternatively, instead of controlling the predetermined level 43 of the molten metal 16 by elevational positioning of the respective components, it is also contemplated that the tundish 40 could be enclosed in a chamber and the pressure in the chamber varied to adjustably control the level of the second liquid portion 49 in the mold 20. Additionally, it may be found desirable to vertically oscillate the article 12 during withdrawal to further reduce any tendency for partial fusion between the article and the article shaping surface 30.

Other aspects, objects and advantages of this invention can be obtained from a study of the drawings, the disclosure and the appended claims.

I claim:

1. A method for the continuous casting of hollow articles (12), comprising:

feeding molten metal (16) into a casting breech (36) disposed at a bottom end (22) of a vertically oriented mold (20);

solidifying a first portion of the molten metal (16) in said mold (20) to form a hollow articles (12);

withdrawing said hollow articles (12) from an upper end (24) of said mold (20); and, concurrently removing a liquid second portion (49) of said molten metal (16) from the upper end (24) of said mold (20) and discharging said liquid second portion through a discharge end of a liquid metal removing means located below said bottom end of said mold.

2. The method of claim 1 wherein the step of concurrently removing the liquid second portion (49) includes withdrawing the liquid second portion (49) at the upper end (24) of the mold (20) at a linear flow rate greater than the linear withdrawal rate of the hollow articles (12).

3. In an apparatus (10) for the continuous casting of hollow articles (12), said apparatus (10) having a vertically oriented mold (20), said mold having an upper end (24) and a lower end (22), a casting breech (36) in communication with the lower end (22) of said mold (20), means (38) for providing a supply of molten metal (16) to said casting breech (36), means (26) for cooling the mold (20), and means (44) for withdrawing a solidified hollow article (12) from the upper end (24) of said mold (20), the improvement comprising:

a drain tube (50) having inlet and discharge ends (52,54) and being centrally disposed within said mold (20) and said breech (36), with said inlet end (52) positioned elevationally adjacent the upper end of said mold (24) and said discharge end (54) spaced elevationally below said casting breech (36).

4. The apparatus (10) as set forth in claim 3, including a means (64) for draining said mold (20) and said casting breech (36).

5. The apparatus (10) as set forth in claim 4 wherein the drain tube (50) includes an external wall (56), an internal wall (58), and a transverse port (60), said internal wall (58) defining a longitudinal passage (62) between said inlet end (52) and said discharge end (54), and said transverse port (60) communicates said external wall (56) and said longitudinal passage (62).

6. The apparatus (10) as set forth in claim 5 wherein said means (64) for draining said mold (20) and said casting breech (36) is a rotary gate valve (66) partially disposed within the casting breech (36) and circumscribing a portion of the external wall (56) of said drain tube (50), said valve (66) having a port (68) positionable between a first position with respect to said transverse port (60) in the drain tube (50) and a second position.

7. An apparatus (10) for the continuous casting of hollow articles (12), comprising:

a vertically-oriented mold (20) having a lower inlet end (22) and an upper discharge end (24);

a casting breech (36) being in communication with said lower inlet end (22) of the mold (20);

means (38) for providing a supply of molten metal (16) to said casting breech (36);

means (26) for cooling said mold (20);

means (44) for continuously withdrawing a solidified hollow article (12) from the upper end (24) of said mold (20); and means (48) for removing portion of said molten metal (49) from the upper end (24) of said mold (20) and discharging said portion of said liquid metal through a discharge end of said removing means located below said lower inlet end (22) of said mold (20) concurrently with the removal of said solidified hollow article (12).

8. The apparatus (10) as set forth in claim 7, wherein the means (48) for removing liquid metal (49) from the upper end (24) of said mold (20) includes a vertically oriented drain tube (50) having an inlet end (52) and a discharge end (54), said tube (50) being centrally disposed within said mold (20) and said breech (36), said inlet end (52) being positioned elevationally adjacent the upper end (24) of said mold (20), and said discharge end (54) being spaced elevationally below said casting breech (36).

9. The apparatus (10) as set forth in claim 8, including a means (64) for draining said mold (20) and said casting breech (36).

10. The apparatus (10) as set forth in claim 9, wherein the drain tube (50) includes an external wall (56), an internal wall (58), and a transverse port (60), said internal wall (58) defining a longitudinal passage (62) between said inlet end (52) and said discharge end (54), and said transverse port (60) is in communication with said external wall (56) and said longitudinal passage (62), and wherein said means (64) for draining said mold (20) and said casting breech (36) is a rotary gate valve (66) partially disposed within the casting breech (36) and circumscribing a portion of the external wall (56) of said drain tube (50), said valve (66) having a port (68) positionable between a first non-aligned position with respect to said transverse port (60) in the drain tube (50) and a second aligned position with respect to said transverse port (60).

* * * * *